US010352575B2

(12) United States Patent
Dingle et al.

(10) Patent No.: US 10,352,575 B2
(45) Date of Patent: Jul. 16, 2019

(54) VAPOR COMPRESSION DEHUMIDIFIER

(71) Applicant: THERMA-STOR LLC, Madison, WI (US)

(72) Inventors: Steven S. Dingle, McFarland, WI (US); Marco A. Tejeda, Madison, WI (US); Timothy S. O'Brien, DeForest, WI (US); Todd R. DeMonte, Cottage Grove, WI (US); Vincent Yu, Madison, WI (US)

(73) Assignee: Therma-Stor LLC, Madison, WI (US)

( * ) Notice: Subject to any disclaimer, the term of this patent is extended or adjusted under 35 U.S.C. 154(b) by 0 days.

(21) Appl. No.: 15/405,459

(22) Filed: Jan. 13, 2017

(65) Prior Publication Data

US 2017/0122578 A1 May 4, 2017

Related U.S. Application Data

(63) Continuation of application No. 14/592,982, filed on Jan. 9, 2015, now Pat. No. 9,581,345, which is a (Continued)

(51) Int. Cl.

| | |
|---|---|
| ***F24F 3/14*** | (2006.01) |
| ***F24F 11/00*** | (2018.01) |
| ***F24F 3/153*** | (2006.01) |

(52) U.S. Cl.

CPC ..... *F24F 3/153* (2013.01); *F24F 3/1405* (2013.01); *F24F 11/0008* (2013.01)

(58) Field of Classification Search

CPC ..... F24F 3/152; F24F 3/1405; F24F 11/008; F25D 17/06; F25D 3/14; F25D 2203/1032; F25B 29/00

See application file for complete search history.

(56) References Cited

U.S. PATENT DOCUMENTS

| | | | |
|---|---|---|---|
| 2,438,120 | A | 3/1948 | Freygang |
| 2,682,758 | A | 7/1954 | Harris |

(Continued)

FOREIGN PATENT DOCUMENTS

| | | |
|---|---|---|
| DE | 87 07 953 | 7/1988 |
| JP | 09-089297 A | 4/1997 |

(Continued)

OTHER PUBLICATIONS

Owner's Manual—Phoenix R150 LGR Dehumidifier, Installation, Operation and Service Instructions, Therma-Stor LLC, Phoenix™ Restoration Equipment, Jan. 2012.

(Continued)

*Primary Examiner* — Melvin Jones
(74) *Attorney, Agent, or Firm* — Baker Botts L.L.P.

(57) ABSTRACT

An apparatus comprises an air inlet configured to receive an inlet airflow. The inlet airflow comprises a process airflow and a bypass airflow. An evaporator unit receives a flow of refrigerant and is cools the process airflow by facilitating heat transfer from the process airflow to the flow of refrigerant. A condenser unit receives the flow of refrigerant and (1) reheats the process airflow by facilitating heat transfer from the flow of refrigerant to the process airflow, and (2) heats the bypass airflow by facilitating heat transfer from the flow of refrigerant to the bypass airflow. The process airflow is discharged via a process airflow outlet and the bypass airflow is discharged via a bypass airflow outlet.

26 Claims, 2 Drawing Sheets

Related U.S. Application Data continuation of application No. 13/468,852, filed on May 10, 2012, now Pat. No. 8,938,981.

(56) References Cited

U.S. PATENT DOCUMENTS

| | | | | |
|---|---|---|---|---|
| 3,880,224 | A | 4/1975 | Weil | |
| 4,250,629 | A | 2/1981 | Lewis | |
| 5,634,353 | A | 6/1997 | Hallin et al. | |
| 5,901,565 | A | 5/1999 | Morton, Jr. | |
| 5,927,090 | A * | 7/1999 | Ladendorf | B60H 1/3232 296/24.35 |
| 7,086,242 | B2 | 8/2006 | Maeda | |
| 7,194,870 | B1 | 3/2007 | O'Brien et al. | |
| 7,246,503 | B1 | 7/2007 | O'Brien et al. | |
| 7,281,389 | B1 * | 10/2007 | O'Brien | F24F 1/04 62/272 |
| 7,540,166 | B2 | 6/2009 | O'Brien et al. | |
| 7,779,643 | B2 | 8/2010 | Simons | |
| 7,913,501 | B2 | 3/2011 | Ellis et al. | |
| 8,069,681 | B1 | 12/2011 | Cink et al. | |
| 2002/0119044 | A1 * | 8/2002 | O'Connor, Jr. | F04D 29/4246 415/204 |
| 2004/0253098 | A1 * | 12/2004 | Hancock | F04D 17/02 415/206 |
| 2005/0257551 | A1 * | 11/2005 | Landry | F24F 3/1411 62/271 |
| 2008/0104974 | A1 | 5/2008 | Dickmann | |
| 2009/0205354 | A1 | 8/2009 | Brown | |
| 2010/0212334 | A1 * | 8/2010 | DeMonte | F24F 1/04 62/93 |
| 2010/0275630 | A1 * | 11/2010 | DeMonte | F24F 1/04 62/272 |
| 2010/0304654 | A1 | 12/2010 | Kakizaki et al. | |
| 2015/0204586 | A1 * | 7/2015 | Burg | F25B 30/02 62/324.6 |

FOREIGN PATENT DOCUMENTS

| | | | |
|---|---|---|---|
| JP | 2937090 | B2 | 8/1999 |
| JP | 2002-188827 | A | 7/2002 |
| JP | 3 804866 | B1 | 8/2006 |

OTHER PUBLICATIONS

Phoenix R150 Small Size, "Large" Performance, Phoenix™ Restoration Equipment, Sep. 2011.

EP Communication for Application No. 13167342.8-1605 /2662638; 15 pages, dated Nov. 21, 2017.

Communication pursuant to Article 94(3) EPC received from European Patent Office, Application No. 13167342.8, dated Oct. 11, 2018, 8 pages.

* cited by examiner

VAPOR COMPRESSION DEHUMIDIFIER

RELATED APPLICATION

This application is a continuation of U.S. application Ser. No. 14/592,982 filed Jan. 9, 2015 and entitled "Vapor Compression Dehumidifier" which is a continuation of U.S. Ser. No. 13/468,852, filed May 10, 2012, entitled "Vapor Compression Dehumidifier" which is now U.S. Pat. No. 8,938,981 issued Jan. 27, 2015 the disclosure of which is hereby incorporated by reference herein.

TECHNICAL FIELD

This invention relates generally to dehumidification and more particularly to a vapor compression dehumidifier.

BACKGROUND OF THE INVENTION

In certain situations, it is desirable to reduce the humidity of air within a structure. For example, in fire and flood restoration applications, it may be desirable to remove water from a damaged structure by placing a portable dehumidifier within the structure. To be effective in these applications, a portable dehumidifier that is capable of operating at high ambient temperatures and low dew points is desirable. Current dehumidifiers, however, have proven inadequate in various respects.

SUMMARY OF THE INVENTION

According to embodiments of the present disclosure, disadvantages and problems associated with previous systems may be reduced or eliminated.

In certain embodiments, a dehumidification apparatus comprises an air inlet configured to receive an inlet airflow that is separated into a process airflow and a bypass airflow. The system further comprises an evaporator unit operable to cool the process airflow by facilitating heat transfer from the process airflow to a flow of refrigerant as the process airflow passes through the evaporator unit. The system further comprises a condenser unit operable to reheat the process airflow by facilitating heat transfer from the flow of refrigerant to the process airflow as the process airflow passes through a first portion of the condenser unit. The condenser unit is further operable to heat the bypass airflow by facilitating heat transfer from the flow of refrigerant to the bypass airflow as the bypass airflow passes through a second portion of the condenser unit. The system further comprises a process airflow outlet for discharging the process airflow into the structure and a bypass airflow outlet for discharging the bypass airflow into the structure.

Certain embodiments of the present disclosure may provide one or more technical advantages. For example, the dehumidification apparatus of the present invention divides the inlet airflow into a process airflow and a bypass airflow, and those two airflows are discharged via separated outlets. In other words, once separated, the process airflow and the bypass airflow do not mix within the dehumidification apparatus. As a result of this separation, the process airflow being discharged from the system may have a lower absolute humidity than an airflow consisting of a combination of the process airflow and the bypass airflow (as the bypass airflow does not pass through the evaporator unit). The lower humidity of the process airflow may allow for increased drying potential, which may be beneficial in certain applications (e.g., fire and flood restoration).

Certain embodiments of the present disclosure may include some, all, or none of the above advantages. One or more other technical advantages may be readily apparent to those skilled in the art from the figures, descriptions, and claims included herein.

BRIEF DESCRIPTION OF THE DRAWINGS

To provide a more complete understanding of the present invention and the features and advantages thereof, reference is made to the following description taken in conjunction with the accompanying drawings, in which.

DETAILED DESCRIPTION OF THE DRAWINGS

Figure 1:
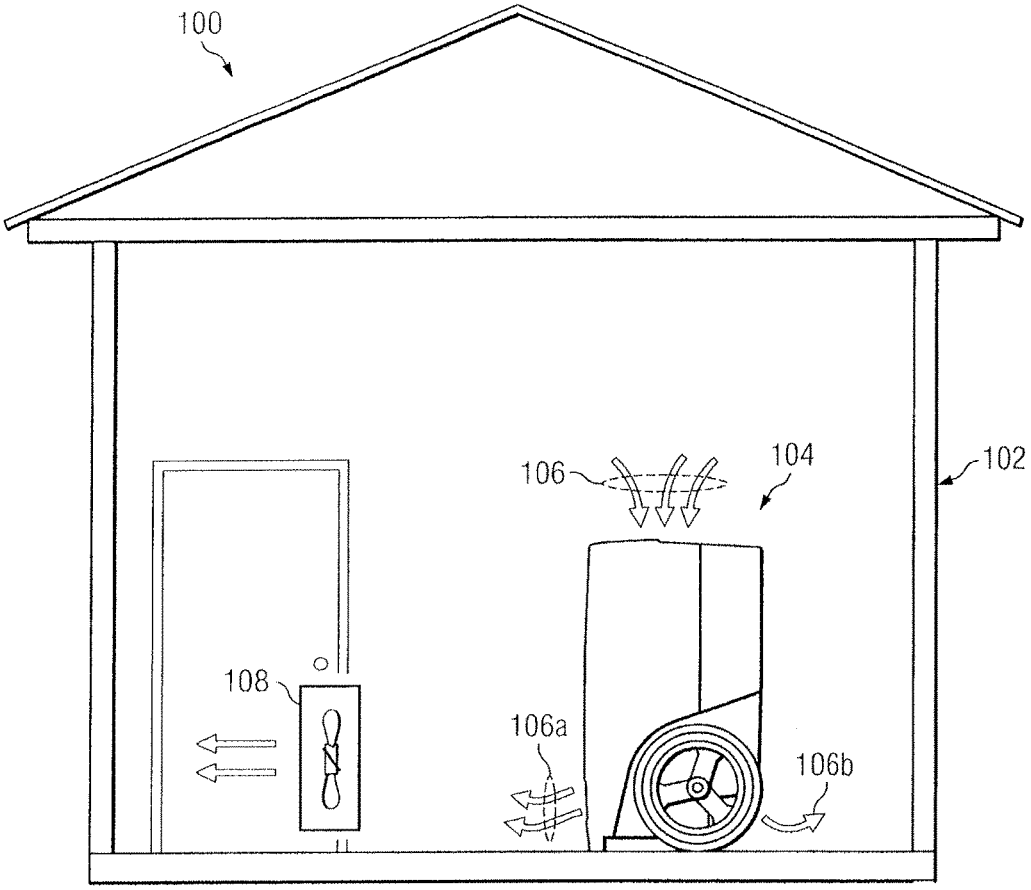
FIG. 1 illustrates an example dehumidification system for reducing the humidity of the air within a structure, according to certain embodiments of the present disclosure.

FIG. 1 illustrates an example dehumidification system 100 for reducing the humidity of the air within a structure 102, according to certain embodiments of the present disclosure. Dehumidification system 100 may include a dehumidification unit 104 configured to be positioned within the structure 102. Dehumidification unit 104 is operable to receive an inlet airflow 106, remove water from the inlet airflow 106, and discharge dehumidified air back into structure 102 (as described in further detail below with regard to FIG. 2). Structure 102 may include all or a portion of a building or other enclosed space, such as an apartment, a hotel, an office space, a commercial building, or a private dwelling (e.g., a house). In certain embodiments, structure 102 includes a space that has suffered water damage (e.g., as a result of a flood or fire). In order to restore the water-damaged structure 102, it may be desirable to remove water from the structure 102 by placing one or more dehumidification units 104 within the structure 102, the dehumidification unit(s) 104 operable to reduce the absolute humidity of the air within the structure 102 (thereby drying the structure 102).

As described in detail below with regard to FIG. 2, dehumidification unit 104 may remove water from inlet airflow 106 by dividing it into a process airflow 106*a* and a bypass airflow 106*b*. The process airflow 106*a* may be dehumidified as it passes through an evaporator unit 126 followed by a condenser unit 122. The dehumidified process airflow 106*a* may then be discharged back into the structure via a process airflow outlet 114. The bypass airflow 106*b*, which may not be dehumidified (as it bypasses the evaporator unit 126), may serve to increase the efficiency of the evaporator unit 126 by absorbing heat from a refrigerant flow 118 as it passes through the condenser unit 122 (thereby increasing the amount of water that may be removed from the process airflow 106*a*). The heated process airflow 106*b* may them be discharged back into the structure 102 via a bypass airflow outlet 116.

The above-discussed configuration of dehumidification unit 104 may provide a number of technical advantages. As just one example, separately-discharging the process airflow 106*a* into the structure 102 may be more effective for drying surfaces onto which it is directed than a mixed airflow (a combination of the process airflow 106*a* and bypass airflow 106*b*) as a mixed airflow would have a higher absolute humidity than the process airflow 106*a* alone. Accordingly, dehumidification unit 104 may be more effective at drying surfaces onto which the process airflow 106 is directed (e.g., the floor of a water-damaged structure 102).

In certain embodiments, system 100 may include one or more air movers 108 positioned within the structure 102. Air movers 108 may distribute the air 106 discharged by dehumidification unit 104 throughout structure 102. Air movers 108 may include standard propeller type fans or any other suitable devices for producing a current of air that may be used to circulate dehumidified process airflow 106*a* and/or heated bypass airflow 106*b* throughout structure 102. Although FIG. 1 depicts only a single air mover 108 positioned within structure 102, one or more additional air movers 108 may also be selectively positioned within structure 102 to promote the circulation of dehumidified process airflow 106*a* and/or heated bypass airflow 106*b* through structure 102, as desired.

In certain embodiments, air movers 108 may be positioned within structure 102 such that the dehumidified process airflow 106*a* exiting dehumidification unit 104 is directed toward a surface in need of drying. Because a surface in need of drying may be commonly found on the floor of structure 102 (e.g., carpet or wood flooring of a water damaged structure 102), the output side of air mover 108 may be configured to direct the dehumidified process airflow 106*a* exiting dehumidification unit 104 toward the floor of structure 102. In certain embodiments, the output side of air mover 108 may include a modified circle that includes an elongated corner configured to direct air in a generally downward direction. An example of such an air mover may be that sold under the name Phoenix Axial Air Mover with FOCUS™ Technology or Quest Air AMS 30 by Therma-Stor, L.L.C., which is described in U.S. Pat. No. 7,331,759 issued to Marco A. Tejeda and assigned to Technologies Holdings Corp. of Houston, Tex.

Although a particular implementation of system 100 is illustrated and primarily described, the present disclosure contemplates any suitable implementation of system 100, according to particular needs. Moreover, although various components of system 100 have been depicted as being located at particular positions within structure 102, the present disclosure contemplates those components being positioned at any suitable location, according to particular needs.

Figure 2:
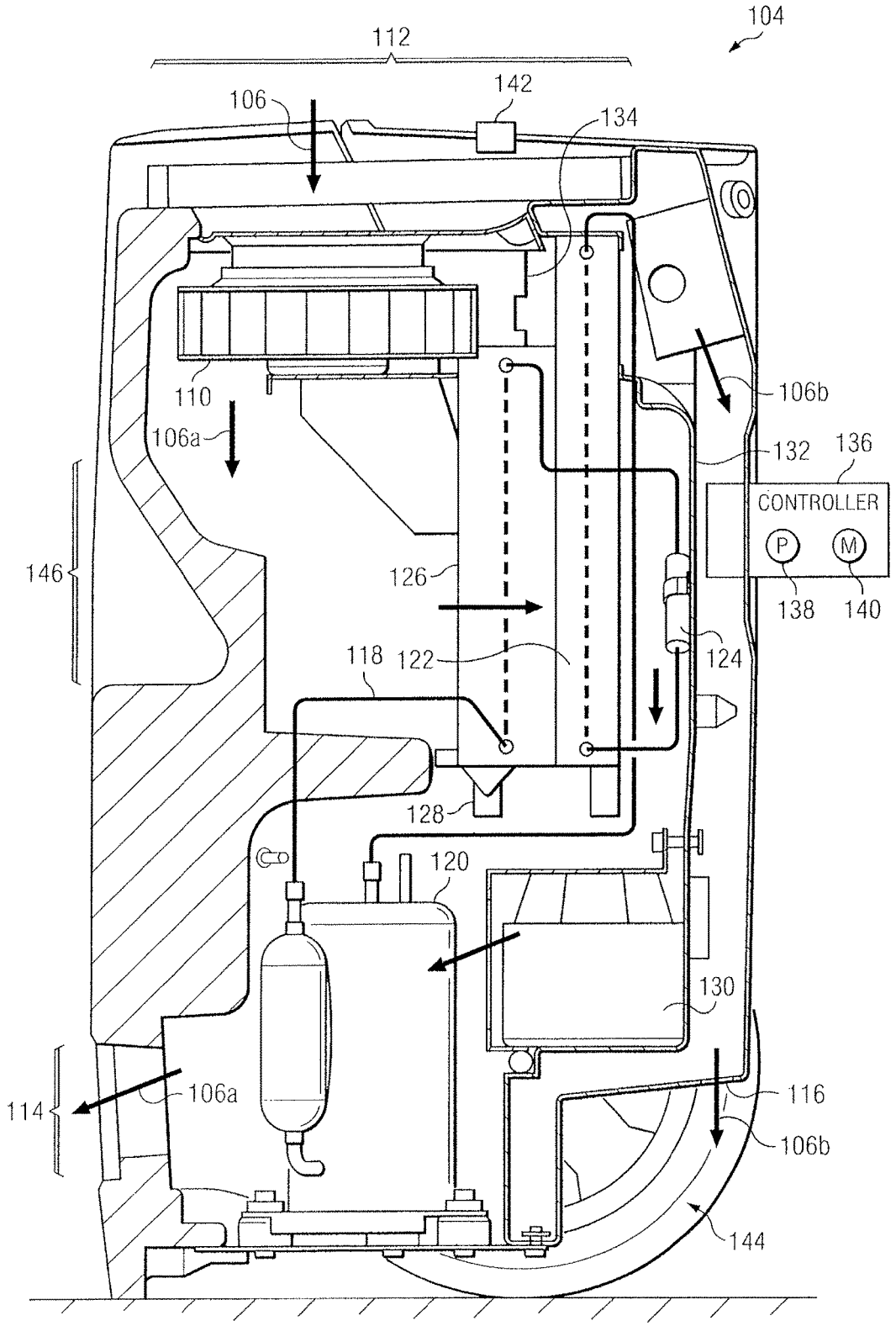
FIG. 2 illustrates detailed view of an example dehumidification unit, according to certain embodiments of the present disclosure.

FIG. 2 illustrates a detailed view of an example dehumidification unit 104, according to certain embodiments of the present disclosure. Dehumidification unit 104 may include a supply fan 110 that draws the inlet airflow 106 through an air inlet 112. Because the inlet airflow 106 is divided into a process airflow 106*a* and bypass airflow 106*b* that remain separate throughout dehumidification unit 104, dehumidification unit 104 additionally includes two separate outlets—a process airflow outlet 114 and a bypass airflow outlet 116. In order to facilitate dehumidification of the air within a structure 102, dehumidification unit 104 further includes a closed refrigeration loop in which a refrigerant flow 118 passes through a compressor unit 120, a condenser unit 122, an expansion device 124, and an evaporator unit 126.

Air inlet 112 may be configured to receive inlet air flow 106 from inside a structure 102. In certain embodiments, inlet air flow 106 may be drawn through air inlet 112 by a supply fan 110. Supply fan 110 may include any suitable component operable to draw inlet air flow 106 into dehumidification unit 104 from within structure 102. For example, supply fan 110 may comprise a backward inclined impeller positioned adjacent to air inlet 112. As a result, supply fan 110 may serve to divide inlet airflow 106 into a process airflow 106*a* (the portion of the inlet airflow forced downward by supply fan 110) and a bypass airflow 106*b* (the portion of the inlet airflow 106 forced radially outward by supply fan 110). Moreover, positioning supply fan 110 adjacent to air inlet 112 may allow a single supply fan 110 to push the two separate airflows (process airflow 106*a* and bypass airflow 106*b*) through dehumidification unit 104.

The closed refrigeration loop of dehumidification unit may comprise a refrigerant flow 118 (e.g., R410a refrigerant, or any other suitable refrigerant) that passes through a compressor unit 120, a condenser unit 122, an expansion device 124, and an evaporator unit 126. Compressor unit 120 may pressurize refrigerant flow 118, thereby increasing the temperature of refrigerant flow 118. Condenser unit 122, which may include any suitable heat exchanger, may receive the pressurized refrigerant flow 118 from compressor unit 120 and cool the pressurized refrigerant flow 118 by facilitating heat transfer from the refrigerant flow 118 to the process airflow 106*a* and bypass airflow 106*b* passing through condenser unit 122 (as described in further detail below). The cooled refrigerant flow 118 leaving condenser unit 122 may enter an expansion device 124 (e.g., capillary tubes or any other suitable expansion device) operable to reduce the pressure of the refrigerant 118, thereby reducing the temperature of refrigerant flow 118. Evaporator unit 126, which may include any suitable heat exchanger, may receive the refrigerant flow 118 from expansion device 124 and facilitate the transfer of heat from process airflow 106*a* to refrigerant flow 118 as process airflow 106*a* passes through evaporator unit 126. Refrigerant flow 118 may then pass back to condenser unit 120, and the cycle is repeated.

In certain embodiments, the above-described refrigeration loop may be configured such that the evaporator unit 126 operates in a flooded state. In other words, the refrigerant flow 118 may enter the evaporator unit in a liquid state, and a portion of the refrigerant flow 118 may still be in a liquid state as it exits evaporator unit 126. Accordingly, the phase change of the refrigerant flow 118 (liquid to vapor as heat is transferred to the refrigerant flow 118) occurs across the evaporator unit 126, resulting in nearly constant pressure and temperature across the entire evaporator unit 126 (and, as a result, increased cooling capacity).

In operation of an example embodiment of dehumidification unit 104, inlet airflow 106 may be drawn through air inlet 112 by supply fan 110. Supply fan 110 may cause the inlet airflow 106 to be divided into a process airflow 106*a* and a bypass airflow 106*b*. The process airflow 106*a* passes though evaporator unit 126 in which heat is transferred from process airflow 106*a* to the cool refrigerant flow 118 passing through evaporator unit 126. As a result, process airflow 106*a* may be cooled to or below its dew point temperature, causing moisture in the process airflow 106*a* to condense (thereby reducing the absolute humidity of process airflow 106). In certain embodiments, the liquid condensate from process airflow 106*a* may be collected in a drain pan 128 connected to a condensate reservoir 130. Additionally, condensate reservoir 130 may include a condensate pump operable to move collected condensate, either continually or at periodic intervals, out of dehumidification unit 104 (e.g., via a drain hose) to a suitable drainage or storage location.

The dehumidified process airflow 106*a* leaving evaporator unit 126 may enter condenser unit 122. Condenser unit 122 may facilitate heat transfer from the hot refrigerant flow passing through the condenser unit 122 to the process airflow 106*a*. This may serve to reheat the process airflow 106*a*, thereby decreasing the relative humidity of process airflow 106*a*. In addition, refrigerant flow 118 may be cooled prior to entering expansion device 124, which may result in the refrigerant flow 118 having a lower temperature as it passes through the evaporator unit 126. Because the refrigerant flow 118 may have a lower temperature in the evaporator unit 126, the evaporator unit 126 may be able to cool the process airflow 106*a* to lower temperatures and the water removal capacity of evaporator unit 126 may be increased (as the evaporator unit 126 will be able to cool dryer air to or below its dew point temperature).

The reheated process airflow 106*a* exiting condenser unit 122 may be routed through dehumidifier unit 104 and exhausted back into the structure via process airflow outlet 114. In certain embodiments, process airflow 106*a* may pass over compressor unit 120 prior to being exhausted. Because compressor unit 120 generates heat as it compresses refrigerant flow 118, the compressor unit may serve to further heat the process airflow 106*a*, thereby further reducing the relative humidity of the process airflow 106*a*. In certain embodiments, process airflow outlet 114 may be oriented such that the warm, dry process airflow 106*a* exiting dehumidification unit 104 may be directed toward the floor of the structure 102. This may be advantageous because, in certain applications (e.g., fire and flood restoration), materials in need of drying may often be located on the floor of the structure (e.g., carpet or wood flooring).

The bypass airflow 106*b* may bypass the evaporator unit 126 and pass directly through the condenser unit 122. The portion of the condenser unit 122 through which bypass airflow 106*b* passes may be separated from the portion of condenser unit 122 through which process airflow 106*a* passes such that separation between the two airflows is maintained within dehumidification unit 104. As discussed above with regard to process airflow 106*a*, condenser unit 122 may facilitate heat transfer from the hot refrigerant flow 118 passing through condenser unit 122 to bypass airflow 106*b*. This may serve to cool the refrigerant flow 118 prior to entering expansion device 124, which may result in the refrigerant flow 118 having a lower temperature as it passes through the evaporator unit 126 (thereby increasing the water removal capacity of the evaporator unit 126, as discussed above). Moreover, because a portion of the inlet airflow 106 bypasses evaporator unit 126 (i.e., bypass airflow 106*b*), the volume of air flowing through evaporator unit 126 (i.e., process airflow 106*a*) is reduced. As a result, the temperature drop of process airflow 106*a* passing across the evaporator unit 126 is increased, allowing the evaporator unit 126 to cool process airflow 106*a* to lower temperatures (which may increase the water removal capacity of evaporator unit 126 as the evaporator unit 126 will be able to cool dryer air to or below its dew point temperature).

In certain embodiments, bypass airflow 106*b* may pass through the hottest portion of condenser unit 122 (the portion at which the refrigerant flow is received from compressor unit 120). In such embodiments, the temperature differential between the refrigerant flow 118 and the bypass airflow 106*b* may be maximized, resulting in the highest possible amount of heat transfer from refrigerant flow 118 to bypass airflow 106*b*.

The heated bypass airflow 106*b* exiting condenser unit 122 may be routed through dehumidifier unit 104 and exhausted back into the structure via bypass airflow outlet 116. In certain embodiments, bypass airflow 106*b* may be routed adjacent to process airflow 106*a* such that heat may be transferred from bypass airflow 106*b* to process airflow 106*a* (as bypass airflow 106*b* will be at a higher temperature than process airflow 106*a* due to the fact that (1) bypass airflow 106*b* does not pass through evaporator unit 126, and (2) bypass airflow 106*b* passes through the hottest portion of condenser unit 122). For example, bypass airflow 106*b* may be separated from process airflow 106*a* by a thin wall 132 through which heat transfer may take place. Because this heat transfer may serve to further heat process airflow 106*a*, the relative humidity of process airflow 106*a* may be decreased. In certain embodiments, bypass airflow outlet 116 may be oriented such that the heated bypass airflow 106*b* exiting dehumidification unit 104 may be directed toward the floor of the structure 102. This may be advantageous because, in certain applications (e.g., fire and flood restoration), materials in need of drying may often be located on the floor of the structure (e.g., carpet or wood flooring).

In certain embodiments, dehumidification unit 104 may additionally include a bypass damper 134 configured to modulate the proportion of inlet airflow 106 that is included in process airflow 106*a* vs. bypass airflow 106*b*. For example, bypass damper 134 may be communicatively coupled to a controller 136, the controller 136 being operable to control the position of bypass damper 134 (as described in further detail below). Controller 136 may include one or more computer systems at one or more locations. Each computer system may include any appropriate input devices (such as a keypad, touch screen, mouse, or other device that can accept information), output devices, mass storage media, or other suitable components for receiving, processing, storing, and communicating data. Both the input devices and output devices may include fixed or removable storage media such as a magnetic computer disk, CD-ROM, or other suitable media to both receive input from and provide output to a user. Each computer system may include a personal computer, workstation, network computer, kiosk, wireless data port, personal data assistant (PDA), one or more processors within these or other devices, or any other suitable processing device. In short, controller 136 may include any suitable combination of software, firmware, and hardware.

Controller 136 may additionally include one or more processing modules 138. Processing modules 138 may each include one or more microprocessors, controllers, or any other suitable computing devices or resources and may work, either alone or with other components of dehumidification unit 104, to provide a portion or all of the functionality described herein. Controller 136 may additionally include (or be communicatively coupled to via wireless or wireline communication) memory 140. Memory 140 may include any memory or database module and may take the form of volatile or non-volatile memory, including, without limitation, magnetic media, optical media, random access memory (RAM), read-only memory (ROM), removable media, or any other suitable local or remote memory component.

For example, controller 136 may be configured to receive a signal from a humidistat 142 operable to measure the humidity of inlet airflow 106. As the humidity of inlet airflow 106 decreases, controller 136 may modulate bypass damper 134 such that the proportion of inlet airflow 106 that becomes bypass airflow 106*b* is increased. Increasing the proportion of bypass airflow 106*b* may (1) increase the cooling of refrigerant flow 118 in condenser unit 122, thereby decreasing the temperature in evaporator unit 126, and (2) decrease the volume of process airflow 106*a* passing through evaporator unit 126. As a result, the process airflow 106*a* may be cooled to a lower temperature, allowing moisture to be condensed from process airflows 106*a* having a lower absolute humidity.

As another example, controller 136 may be configured to receive a signal from a temperature probe (not depicted) configured to measure the temperature of the refrigerant flow at one or more locations within the refrigerant loop. In response to the measured temperature of refrigerant flow 118, controller 136 may modulate bypass damper 134 such that a desired refrigerant flow temperature is maintained.

In certain embodiments, the above-discussed components of dehumidification unit 104 may be arranged in a portable cabinet. For example, the above-discussed components of dehumidification unit 104 may be arranged in a portable cabinet having wheels 144 such that the dehumidification unit 104 may be easily be moved (i.e., rolled) into a structure 102 in order to dehumidify the air within the structure 102. In addition, the portable cabinet may be designed such that is may be easily stored when not in use. For example, the portable cabinet may include a storage pocket 146 for storing one or more components associated with dehumidification unit 104 when dehumidification unit 104 is not in use (e.g., a power cord and/or a drain hose). As another example, depressions may be formed in the top of the portable cabinet of dehumidification unit 104, the depressions being sized such that they may receive the wheels 144 of a second dehumidification unit 104. As a result, multiple dehumidification units 104 may be stacked when not in use.

Although a particular implementation of dehumidification unit 104 is illustrated and primarily described, the present disclosure contemplates any suitable implementation of dehumidification unit 104, according to particular needs. Moreover, although various components of dehumidification unit 104 have been depicted as being located at particular positions within the portable cabinet and relative to one another, the present disclosure contemplates those components being positioned at any suitable location, according to particular needs.

Although the present disclosure has been described with several embodiments, diverse changes, substitutions, variations, alterations, and modifications may be suggested to one skilled in the art, and it is intended that the disclosure encompass all such changes, substitutions, variations, alterations, and modifications as fall within the spirit and scope of the appended claims.

What is claimed is:

1. An apparatus, comprising:

an air inlet configured to receive an inlet airflow, the inlet airflow comprising a process airflow and a bypass airflow;

an evaporator unit operable to cool the process airflow;

a condenser unit operable to:

reheat the process airflow; and heat the bypass airflow;

a process airflow outlet operable to discharge the process airflow;

a bypass airflow outlet operable to discharge the bypass airflow;

a wall that separates the bypass airflow and the process airflow within the apparatus; and a supply fan positioned adjacent to the air inlet, wherein the supply fan comprises a backward inclined impeller.

2. The apparatus of claim 1, wherein the process airflow outlet is oriented such that the process airflow is directed toward a floor of a structure.

3. The apparatus of claim 1, wherein the bypass airflow outlet is oriented such that the bypass airflow is directed toward a floor of a structure.

4. The apparatus of claim 1, wherein the bypass airflow comprises between ten and thirty percent of the inlet airflow.

5. The apparatus of claim 1, further comprising:

a sensor operable to measure a parameter of the inlet airflow;

a bypass damper operable to control proportions of the inlet airflow that comprise the process airflow and the bypass airflow; and a controller that operates the bypass damper according to the measured parameter of the inlet airflow.

6. The apparatus of claim 1, further comprising:

a sensor operable to measure a parameter of a flow of refrigerant;

a bypass damper operable to control proportions of the inlet airflow that comprise a process airflow and a bypass airflow; and a controller that operates the bypass damper according to the measured parameter of the flow of refrigerant.

7. An apparatus, comprising:

an air inlet configured to receive an inlet airflow, the inlet airflow comprising a process airflow and a bypass airflow;

an evaporator unit operable to cool the process airflow;

a condenser unit operable to:

reheat the process airflow; and heat the bypass airflow;

a process airflow outlet operable to discharge the process airflow; and a bypass airflow outlet operable to discharge the bypass airflow, wherein the bypass airflow outlet is oriented such that the bypass airflow is directed toward a floor of a structure; and a wall that separates the bypass airflow and the process airflow within the apparatus.

8. The apparatus of claim 7, wherein the process airflow outlet is oriented such that the process airflow is directed toward the floor of a structure.

9. The apparatus of claim 7, wherein the bypass airflow comprises between ten and thirty percent of the inlet airflow.

10. The apparatus of claim 7, further comprising:

a sensor operable to measure a parameter of the inlet airflow;

a bypass damper operable to control proportions of the inlet airflow that comprise the process airflow and the bypass airflow; and a controller that operates the bypass damper according to the measured parameter of the inlet airflow.

11. The apparatus of claim 7, further comprising:

a sensor operable to measure a parameter of a flow of refrigerant;

a bypass damper operable to control proportions of the inlet airflow that comprise a process airflow and a bypass airflow; and a controller that operates the bypass damper according to the measured parameter of the flow of refrigerant.

12. An apparatus, comprising:

an air inlet configured to receive an inlet airflow, the inlet airflow comprising a process airflow and a bypass airflow;

an evaporator unit operable to cool the process airflow;

a condenser unit operable to:

reheat the process airflow; and heat the bypass airflow;

a process airflow outlet operable to discharge the process airflow; and a bypass airflow outlet operable to discharge the bypass airflow, wherein the bypass airflow comprises between ten and thirty percent of the inlet airflow.

13. The apparatus of claim 12, wherein the process airflow outlet is oriented such that the process airflow is directed toward a floor of a structure.

14. The apparatus of claim 12, wherein the bypass airflow outlet is oriented such that the bypass airflow is directed toward a floor of a structure.

15. The apparatus of claim 12, further comprising:

a sensor operable to measure a parameter of the inlet airflow;

a bypass damper operable to control proportions of the inlet airflow that comprise the process airflow and the bypass airflow; and a controller that operates the bypass damper according to the measured parameter of the inlet airflow.

16. The apparatus of claim 12, further comprising:

a sensor operable to measure a parameter of a flow of refrigerant;

a bypass damper operable to control proportions of the inlet airflow that comprise a process airflow and a bypass airflow; and a controller that operates the bypass damper according to the measured parameter of the flow of refrigerant.

17. An apparatus, comprising:

an air inlet configured to receive an inlet airflow, the inlet airflow comprising a process airflow and a bypass airflow;

an evaporator unit operable to cool the process airflow;

a condenser unit operable to:

reheat the process airflow; and heat the bypass airflow;

a process airflow outlet operable to discharge the process airflow;

a bypass airflow outlet operable to discharge the bypass airflow;

a sensor operable to measure a parameter of the inlet airflow;

a bypass damper operable to control proportions of the inlet airflow that comprise the process airflow and the bypass airflow; and a controller that operates the bypass damper according to the measured parameter of the inlet airflow.

18. The apparatus of claim 17, wherein the process airflow outlet is oriented such that the process airflow is directed toward a floor of a structure.

19. The apparatus of claim 17, wherein the bypass airflow outlet is oriented such that the bypass airflow is directed toward a floor of a structure.

20. The apparatus of claim 17, wherein the bypass airflow comprises between ten and thirty percent of the inlet airflow.

21. The apparatus of claim 17, further comprising:

a sensor operable to measure a parameter of a flow of refrigerant;

a bypass damper operable to control proportions of the inlet airflow that comprise a process airflow and a bypass airflow; and a controller that operates the bypass damper according to the measured parameter of the flow of refrigerant.

22. An apparatus, comprising:

an air inlet configured to receive an inlet airflow, the inlet airflow comprising a process airflow and a bypass airflow;

an evaporator unit operable to cool the process airflow;

a condenser unit operable to:

reheat the process airflow; and heat the bypass airflow;

a process airflow outlet operable to discharge the process airflow;

a bypass airflow outlet operable to discharge the bypass airflow;

a sensor operable to measure a parameter of a flow of refrigerant;

a bypass damper operable to control proportions of the inlet airflow that comprise a process airflow and a bypass airflow; and a controller that operates the bypass damper according to the measured parameter of the flow of refrigerant.

23. The apparatus of claim 22, wherein the process airflow outlet is oriented such that the process airflow is directed toward a floor of a structure.

24. The apparatus of claim 22, wherein the bypass airflow outlet is oriented such that the bypass airflow is directed toward a floor of a structure.

25. The apparatus of claim 22, wherein the bypass airflow comprises between ten and thirty percent of the inlet airflow.

26. The apparatus of claim 22, further comprising:

a sensor operable to measure a parameter of the inlet airflow;

a bypass damper operable to control the proportions of the inlet airflow that comprise the process airflow and the bypass airflow; and a controller that operates the bypass damper according to the measured parameter of the inlet airflow.

* * * * *